US008360896B2

(12) United States Patent
Hackenberg

(10) Patent No.: US 8,360,896 B2
(45) **Date of Patent: *Jan. 29, 2013**

(54) SWING TRAINER

(75) Inventor: James A. Hackenberg, Easley, SC (US)

(73) Assignee: Jimmy Hack Golf, LLC, Easley, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/506,042

(22) Filed: Mar. 21, 2012

(65) Prior Publication Data

US 2012/0178552 A1 Jul. 12, 2012

Related U.S. Application Data

(63) Continuation of application No. 12/807,211, filed on Aug. 30, 2010, now Pat. No. 8,142,305.

(51) Int. Cl.
*A63B 69/36* (2006.01)
*A63B 23/00* (2006.01)

(52) U.S. Cl. ..... 473/278; 473/409; 482/51; 482/146

(58) Field of Classification Search ..... 473/217, 473/218, 266–273, 278, 279, 409; 482/1–9, 482/51, 52, 54, 74, 75, 123, 127, 130, 142, 482/146–148

See application file for complete search history.

(56) References Cited

U.S. PATENT DOCUMENTS

| | | | | |
|---|---|---|---|---|
| 2,615,495 | A | 10/1952 | Hilliker | |
| 2,826,424 | A | 3/1958 | Erickson | |
| 2,842,365 | A | 7/1958 | Kelley | |
| 2,878,858 | A | 3/1959 | Winchester | |
| 2,930,430 | A | 3/1960 | Bloom | |
| 2,950,120 | A * | 8/1960 | Stewart | 482/51 |
| 3,451,672 | A * | 6/1969 | Kazdan | 472/4 |
| 3,586,321 | A * | 6/1971 | Gehrke et al. | 482/146 |
| 3,862,768 | A | 1/1975 | England | |
| 4,830,345 | A | 5/1989 | Mar | |
| 4,917,385 | A | 4/1990 | Brown | |
| 5,062,629 | A | 11/1991 | Vaughan | |
| D518,865 | S * | 4/2006 | Goldman et al. | D21/803 |
| 7,094,183 | B2 | 8/2006 | Hsieh | |
| 7,470,218 | B2 | 12/2008 | Williams | |
| 7,695,407 | B2 * | 4/2010 | Miller et al. | 482/51 |
| 7,901,304 | B1 | 3/2011 | Moore | |
| 8,142,305 | B2 * | 3/2012 | Hackenberg | 473/278 |
| 2002/0128133 | A1 | 9/2002 | Broudy | |
| 2006/0082089 | A1 | 4/2006 | Rejtano | |

OTHER PUBLICATIONS

U.S. Appl. No. 12/807,211, filed Aug. 30, 2010.

* cited by examiner

*Primary Examiner* — Nini Legesse
(74) *Attorney, Agent, or Firm* — Craig R. Miles; CR Miles, P.C.

(57) ABSTRACT

A sports activity swing trainer having a concave curved surface area on which a person stands to practice a swing for a sports activity.

18 Claims, 4 Drawing Sheets

SWING TRAINER

This United States patent application is a continuation of U.S. patent application Ser. No. 12/807,211, filed Aug. 30, 2010, hereby incorporated by reference herein.

I. BACKGROUND

A sports activity swing trainer having a concave curved surface area on which a person stands to practice a swing for a sports activity.

A person typically practices a sports activity swing on a generally flat support surface. The person from practice session to practice session and from swing to swing learns the sports activity swing in relation to a limited range of difference in the person's center of gravity. However, this approach does not challenge the person to alter the sports activity swing or develop a sports activity swing responsive to a wide range of difference in the person's center of gravity.

II. SUMMARY OF THE INVENTION

Accordingly, a broad object of the invention can be to provide a sports activity swing trainer which provides a concave curved surface adapted to allow a person to stand on while practicing a sports activity swing.

Another broad object of the invention can be to provide a method of sports activity swing training in which a person alters location of the feet on a concaved curved surface to corresponding alter the person's center of gravity which challenges the person to develop a sports activity swing responsive to the change in the person's center of gravity.

Naturally, further objects of the invention are disclosed throughout other areas of the specification, drawings, photographs, and claims.

III. A BRIEF DESCRIPTION OF THE DRAWINGS

FIG. 1 provides an illustration of a method of using embodiments of a sports activity swing trainer.

IV. DETAILED DESCRIPTION OF THE PREFERRED EMBODIMENTS

Figure 1:
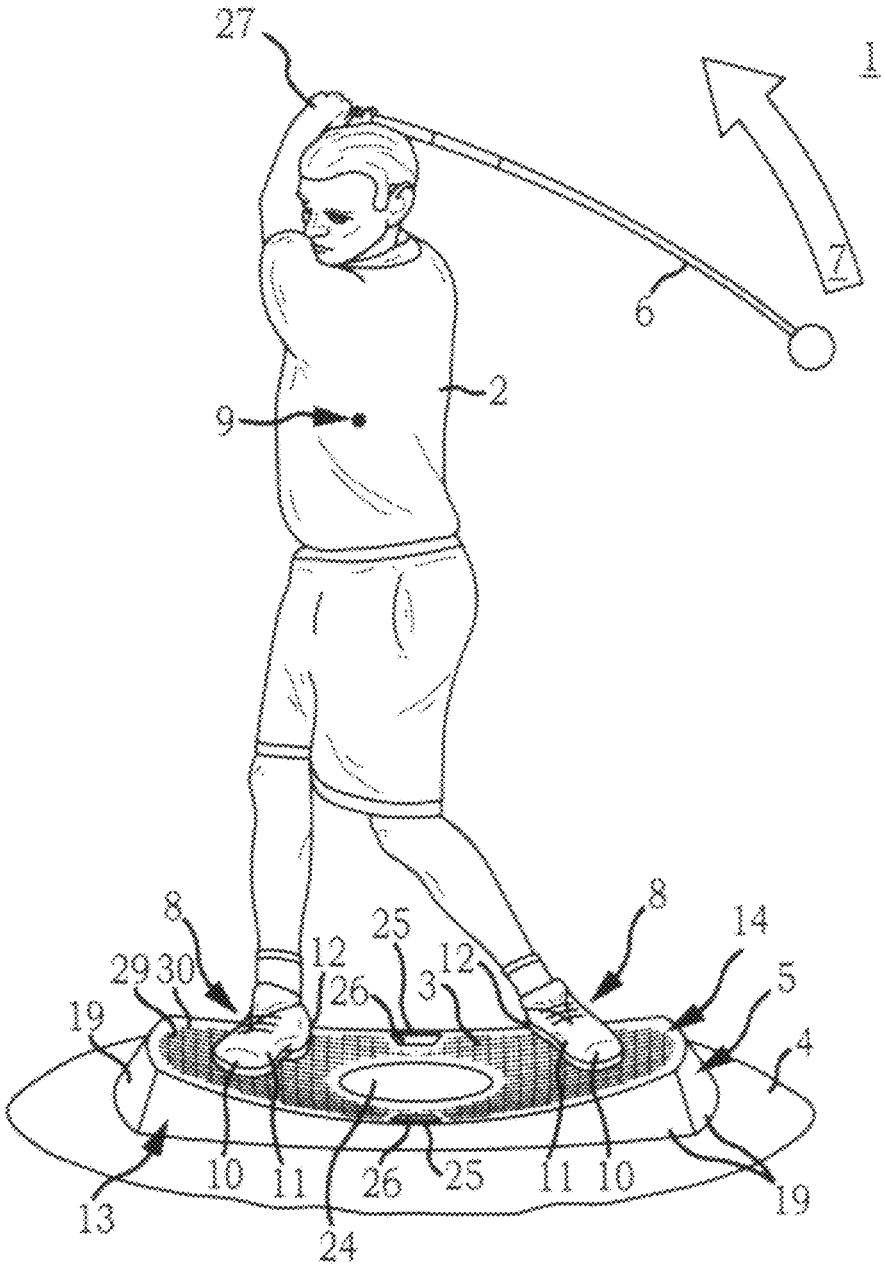

First referring primarily to FIG. 1, a particular embodiment of a method of sports activity swing training (1) is shown in which a person (2) stands on a concave curved surface area (3) supported by a base (5) in fixed relation to a support surface (4). The person (2) standing on the concave curved surface area (3) can swing an elongate member (6) through one or more sports activity swings (7). The elongate member (6) can be one of a variety of swingable elongate members (6) such as a golf club, any of a numerous and wide varieties of sports activity swing trainers, baseball bat, baton, tennis racquet, racquet ball racquet, or the like. The standing location (8) on the concave curved surface (3) can be altered to correspondingly alter the center of gravity (9) of the person (2) during said step of swinging the elongate member (6) through one or more sports activity swings (7). By standing on the concave curved surface area (3) at a standing location (8) which raises the toes (10) of the foot (11) in relation to a heel (12) of the foot (11) moves the person's (2) center of gravity (9) backward. Conversely, by standing on the concave curved surface area (3) at a location which raises the heel (12) in relation to the toes (10) shifts the person's (2) center of gravity (9) forward. Each foot (11) of a person (2) can be located in essentially limitless combinations on the concave curved surface area (3) which correspondingly shifts the person's (2) center of gravity (9) to different locations. Altering the person's (2) center of gravity (9) further alters the swing plane of the sports activity swing (7). The swing plane affects the direction and velocity of a sports activity ball hit with a sports activity club. By using the method above described the person (2) can experience a wide and numerous variation in center of gravity (9) affecting the swing plane of the sports activity swing (7). Accordingly, the person will quickly learn to adjust the sports activity swing (7) to compensate for the change in center of gravity (9).

Additionally, embodiments of the method of sports activity swing training (1), above described, encourages rotary motion of the upper body in relation to the lower body. The upper body and lower body are capable of twisting in opposite directions. This upper body can rotate all the way through to the other side ideally in balance and with a minimal lateral motion to generate the greatest speed, power and repetition accuracy in the swing (7). When feet (11) are positioned on the concave curved surface (3) as above-described rotary motion is encouraged and lateral motion is discouraged. This occurs because the concave curved surface (3) 'pinches' the body to stay centered and balanced as person (2) rotates. The more balanced the person (2), the faster the swing (7).

Now referring primarily to FIGS. 2-6, a particular embodiment of a sports activity swing trainer (13) is shown which includes a top (14) providing a concave curved surface area (3) adapted to support a person (2) standing on the concave curved surface area (3). A base (5) coupled to the top (14) can be configured to support the concave curved surface area (3) in substantially rigidly fixed relation to the support surface (4) which allows the person (2) to stand within the concave curved surface area (3). The term "substantially rigidly fixed relation to the support surface" for the purposes of this invention means that embodiments of the concave curved surface are substantially inflexible or do not move in relation to the support surface in response to a person standing on the concave curved surface". This differentiates the concave curved surface of the invention from other conventional training devices such as inflatable balance trainers or compressible balance trainers which have surfaces that are substantially altered in configuration and move in relation to a support surface in response to a person standing on the trainer.

As to certain embodiments of the sports activity swing trainer (13), the concave curved surface area (3) can provide substantially the entirety of the surface area of the top (14) (as shown in the Figures), while as to other embodiments of the sports activity swing trainer (13), the concave curved surface area (3) can comprise a portion of the top (14). The concave curved surface area (3) can have dimensional relations which are sufficient to allow a person (2) to stand within the concave curved surface area (3); however, certain embodiments of the sports activity swing trainer (13) can provide a concave curved surface area (3) of substantially greater area and even an area sufficient to allow more than one person (2) to stand within the concave curved surface area (3). As to those embodiments configured to allow one person to stand on the concave surface area (3) the length (17) can be in the range of about 36 inches to about 60 inches and the width (16) can be in the range of about 24 inches to 36 inches; but the invention is not so limited.

Again referring primarily to FIGS. 2-6, certain embodiments of the sports activity swinger trainer (13) the concave curved surface area can be curved in single direction along the width (16) or curved in a single direction along the length (17) or curved in both directions along the length (17) and the width (16). The amount of curvature in a single direction can vary between embodiments of the sports activity swing trainer (13) but embodiments of the concave curved surface area (3) can have a radius in the range of about 36 inches and about 90 inches; however, the invention is not so limited, and the amount of curvature can be of lesser or greater radius useful in swing training, as above described. The amount of curvature in the width (16) can be of lesser or greater radius than the length (17) or can be substantially the same. Certain embodiments of the sports activity swing trainer (13) can provide a concave curved surface (3) which has a configuration of a partial sphere (18). As a non-limiting example, the radius of the partial sphere (18) can be in the range of about 36 inches and about 90 inches; however, the invention is not so limited.

Figure 2:
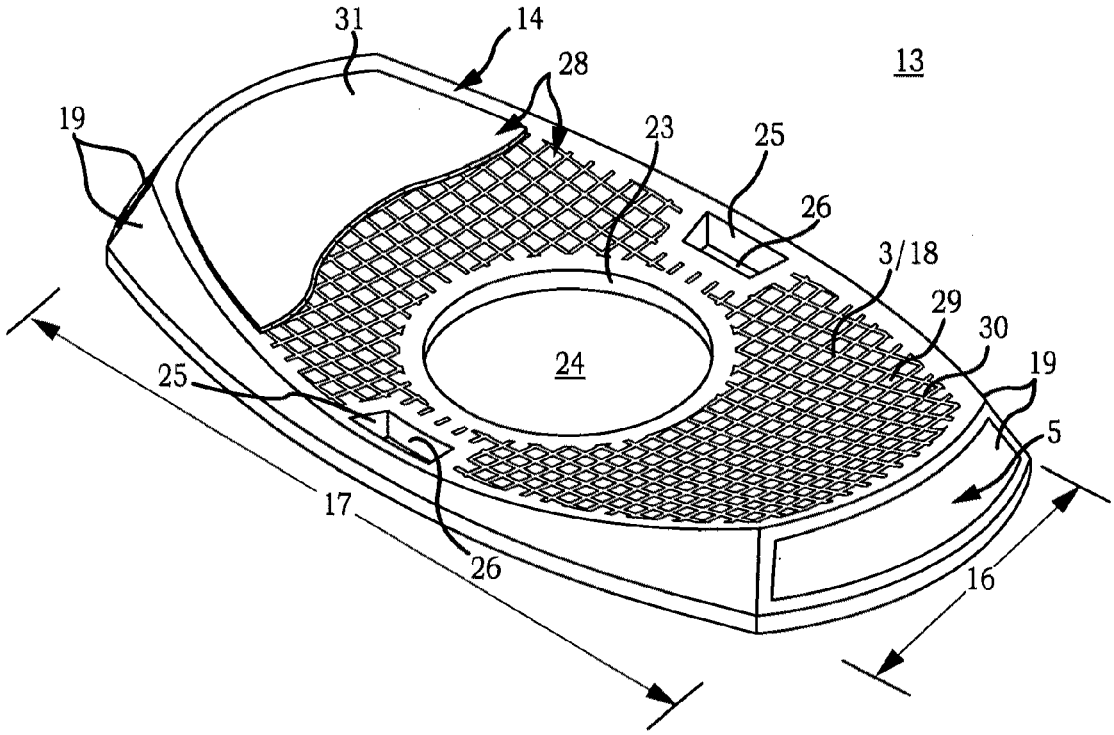
FIG. 2 is a perspective view of a particular embodiment of the sports activity swing trainer.
Figure 3:
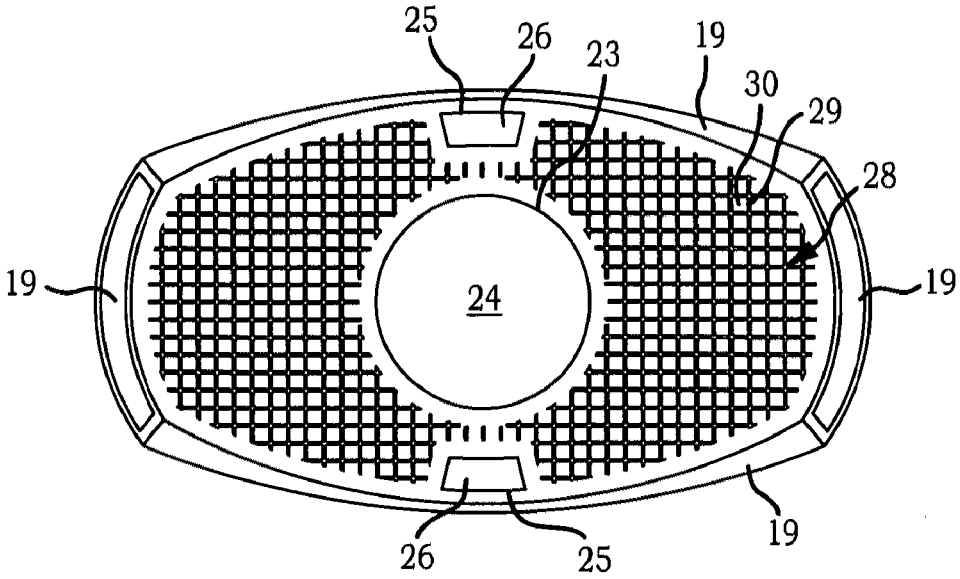
FIG. 3 is a top view of a particular embodiment of the sports activity swing trainer.
Figure 4:
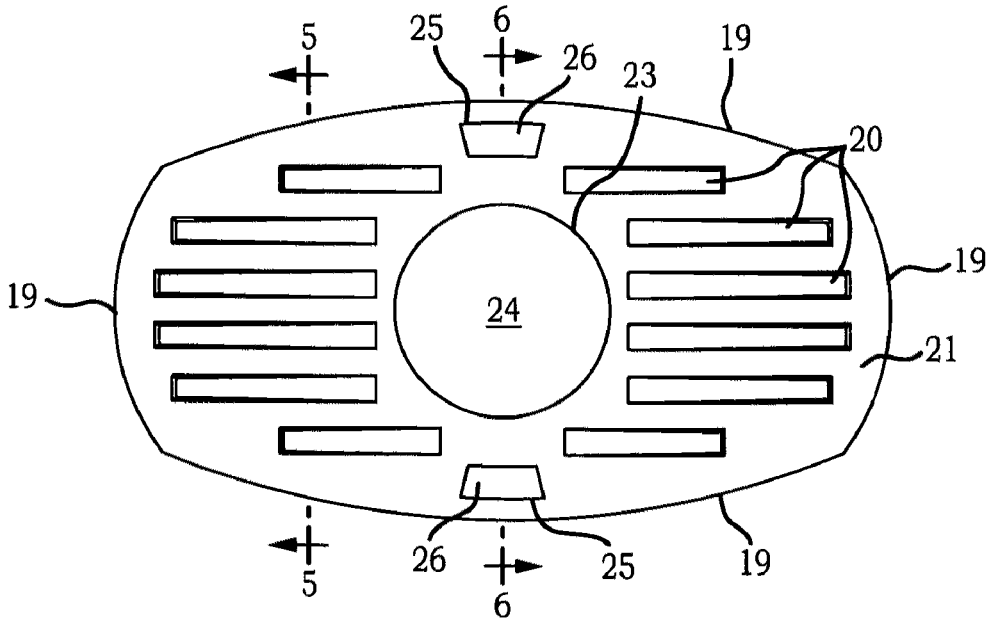
FIG. 4 is a bottom view of a particular embodiment of the sports activity swing trainer.
Figure 5:
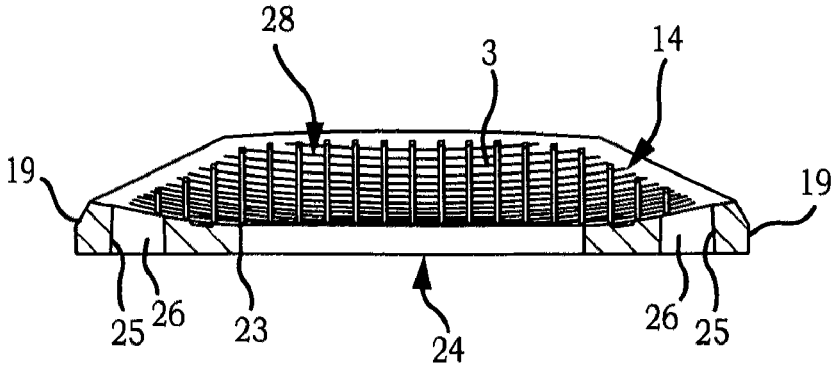
FIG. 5 is cross section 5-5 of the particular embodiment of the sports activity swing trainer shown in FIG. 4.
Figure 6:
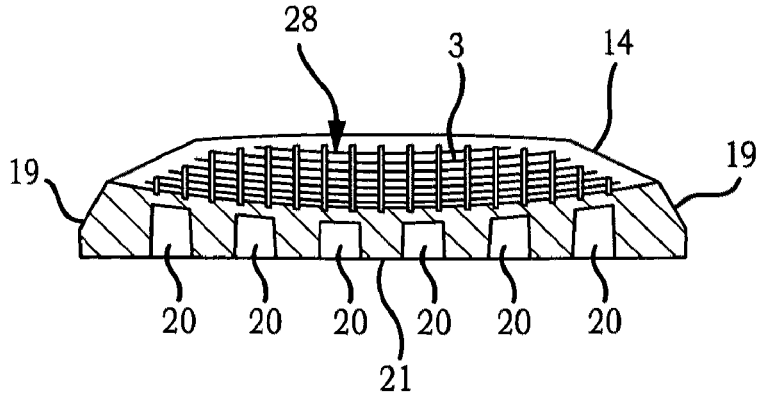
FIG. 6 is cross section 6-6 of the particular embodiment of the sports activity swing trainer shown in FIG. 4.

Now referring primarily to FIGS. 2-6, the base (5) coupled to the top (14) can be of any configuration which supports the concave curved surface area (3) with sufficient stability to allow a person (2) to perform the method of sports activity swing training (1) above-described. Referring specifically to FIGS. 4-6, certain embodiments of the base (5) of the sports activity swing trainer (13) can be a substantially solid constructional form, or can be a solid constructional form reduced in mass by including a plurality of recess elements (20) which communicate with the bottom surface (21) of the base (5) as shown for example in FIGS. 4 through 6. Certain embodiments of the base (5) of the sports activity swing trainer (13) can have a substantially hollow constructional form defined by side walls (19) which bound a hollow space beneath the concave curved surface area (3). Whether the base (5) takes a solid, semi-solid, or hollow constructional form the side walls (19) of the sports activity swing trainer (13) have a height sufficient to establish the entirety of the concave curved surface area (3) above the support surface (4). Accordingly, the height of the side walls (19) can vary depending upon the amount of curvature in the concave curved surface area (3). Understandably, the greater the amount of curvature the greater the height of the side walls (19) to avoid contact of the concave curved surface area (3) with the support surface (4).

Now referring primarily to FIGS. 1-5, certain embodiments of the sports activity swing trainer (13) can further include an aperture element (23) disposed generally in the center of the concave curved surface area (3). The aperture element (23) has dimensional relations which vary depending upon the amount of curvature of the concave curved surface area (3) and the height of the base (5). Understandably, as above-described, if the base (5) has sufficient height no aperture element (23) may be necessary. As the height of the concave surface area (3) approaches the support surface (4) by reduction in height of the base (5), or otherwise, the lowest point within the concave surface area (3) can contact the support surface (4). To produce embodiments of the sports activity swing trainer (13) which establish portions of the concave curved surface area (3) closer to the support surface (4), it may be necessary to remove a portion of the concave curved surface area (3) producing the aperture element (23). As the height of the base (5) is further reduced the open area (24) of the aperture element (23) increases.

Now referring to FIGS. 2 and 3, certain embodiments of the sports activity swing trainer (13) can further include a pass through element (25) which communicates between the bottom surface (21) and the top (14) (which in certain embodiments may be within the concave curved surface area (3)). The pass through element (25) can be located sufficiently proximate the edge of the sports activity swing trainer (13) and can have sufficient pass through area (26) to be grippably engaged by the hand (27) of a person (2).

Again referring to primarily to FIGS. 2 and 3, and FIGS. 4 and 5, certain embodiments of the sports activity swing trainer (13) can further include a friction element (28) coupled to all or a portion of the concave curved surface area (3). The friction element (28) can be provided by a wide and numerous variety of configurations, patterns, or materials made integral or applied to the concave curved surface area (3). As one non-limiting example, the friction element (28) can be a pattern of raised elements (29) applied, molded or otherwise established in the concave curved surface area. Alternately, the raised elements (29) can be established by a pattern of recessed elements (30) molded, fabricated, or cut or otherwise established in the concave curved surface area. Other embodiments of the friction element (29) can include a layer of material (31) (as shown in FIG. 2) which covers all or a portion of the concave curved surface area (3). The layer of material (31) can have slip resistant characteristics integral to the material such as rubber, neoprene, or the like, or can have a roughened or patterned surface such as treads, dimples, or the like, or can have adhesive characteristics; or abrasive characteristics conferred by particles applied to the surface.

As can be easily understood from the foregoing, the basic concepts of the present invention may be embodied in a variety of ways. The invention involves numerous and varied embodiments of a sports activity swing trainer and methods of practicing a sports activity swing.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "sports activity swing trainer" should be understood to encompass disclosure of the act of "sports activity swing training"—whether explicitly discussed or not—and, conversely, were there effectively disclosure of the act of "sports activity swing training", such a disclosure should be understood to encompass disclosure of "sports activity swing trainer" and even a "means for sports activity swing training." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the sports activity swing trainers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A sports activity swing trainer, comprising:

a) a top having a concave curved surface area, said concave curved surface area curved in both directions along the length and the width, and adapted to support a person standing on said concave curved surface area; and b) a base coupled to said top, said base configured to support said concave curved surface area in substantially rigidly fixed relation to a support surface.

2. The sports activity swing trainer as described in claim 1, further comprising an aperture element surrounded by said concave curved surface area, said aperture element communicating with opposed sides of said concaved surface area.

3. The sports activity swing trainer as described in claim 2, wherein said concave curved surface area has a configuration of a partial sphere.

4. The sports activity swing trainer as described in claim 3, wherein said concave curved surface area has a radius in a range of between about 36 inches and about 90 inches.

5. The sports activity swing trainer as described in claim 4, further comprising a friction element coupled to said concave curved surface.

6. The sports activity swing trainer as described in claim 5, wherein said friction element is selected from the group consisting of: a pattern of raised surface elements, a pattern of recessed elements, a layer of friction material, a layer of friction material having patterned surface.

7. A method of producing a sports activity swing trainer, comprising the steps of:

a) providing a top having a concave curved surface area, said concave curved surface area curved in both directions along the length and the width, and adapted to support a person standing on said concave curved surface; and b) coupling a base to said top, said base configured to support said concave curved surface area in fixed relation to a support surface.

8. The method of producing a sports activity swing trainer as described in claim 7, further comprising the step of disposing an aperture element in and surrounded by said concave curved surface area, said aperture element communicating with opposed sides of said concave surface area.

9. The method of producing a sports activity swing trainer as described in claim 8, further comprising the step of configuring said concave curved surface area as a partial sphere.

10. The method of producing a sports activity swing trainer as described in claim 9, further comprising the step of providing said concave curved surface area with a radius in a range of between about 36 inches and about 90 inches.

11. The method of producing a sports activity swing trainer as described in claim 10, further comprising the step of coupling a friction element to said concave curved surface.

12. The method of producing a sports activity swing trainer as described in claim 11, wherein said friction element is selected from the group consisting of: a pattern of raised surface elements, a pattern of recessed elements, a layer of friction material, a layer of friction material having patterned surface.

13. A method of sports activity swing training, comprising the steps of:

a) standing on concave curved surface area, said concave curved surface area curved in both directions along the length and the width, supported in fixed relation to a support surface by a base; and b) performing one or more sports activity swings.

14. The method of sports activity swing training as described in claim 13, further comprising the step of swinging an elongate member.

15. The method of sports activity swing training as described in claim 14, wherein said elongate member comprises a golf club, a baseball bat, a tennis racquet, and a racquet ball racquet.

16. The method of sports activity swing training as described in claim 14, wherein said concave curved surface area comprises a partial sphere and further comprising the step of standing on said partial sphere area at a location which raises toes of a foot in relation to a heal of said foot.

17. The method of sports activity swing training as described in claim 14, further comprising the step of standing on said partial sphere area at a location which raises a heal of a foot in relation to toes of said foot.

18. The method of sports activity swing training as described in claim 13, further comprising the step of altering location at which a person stands on said concave curved surface area.

* * * * *